US007549300B2

(12) United States Patent
Chun et al.

(10) Patent No.: US 7,549,300 B2
(45) Date of Patent: Jun. 23, 2009

(54) RADIATING APPARATUS OF BUILT-IN REFRIGERATOR

(75) Inventors: Chan Ho Chun, Seoul (KR); Yang Kyu Kim, Seoul (KR); Se Young Kim, Seoul (KR); Kyung Sik Kim, Incheon (KR); Hyoung Keun Lim, Suwon (KR); Youn Seok Lee, Goyang-si (KR)

(73) Assignee: LG Electronics Inc., Seoul (KR)

( * ) Notice: Subject to any disclaimer, the term of this patent is extended or adjusted under 35 U.S.C. 154(b) by 646 days.

(21) Appl. No.: 10/914,088

(22) Filed: Aug. 10, 2004

(65) Prior Publication Data

US 2005/0120738 A1 Jun. 9, 2005

(30) Foreign Application Priority Data

Dec. 9, 2003 (KR) ..... 10-2003-0088904

(51) Int. Cl.
*F25D 17/06* (2006.01)

(52) U.S. Cl. ..... 62/419; 62/428; 62/440; 62/443; 62/452; 62/508

(58) Field of Classification Search ..... 62/419, 62/428, 443, 452, 455, 456, 440, 454, 508
See application file for complete search history.

(56) References Cited

U.S. PATENT DOCUMENTS 2,675,901 A * 4/1954 Childers ..... 194/350
3,005,321 A * 10/1961 Devery ..... 62/186
3,736,768 A * 6/1973 Harbour et al. ..... 62/455
4,970,874 A * 11/1990 Solak et al. ..... 62/258
5,347,827 A * 9/1994 Rudick et al. ..... 62/440
5,881,567 A * 3/1999 Junge et al. ..... 62/428
2004/0016256 A1 1/2004 Chung et al.
2004/0163408 A1* 8/2004 Kim et al. ..... 62/428

(Continued)

FOREIGN PATENT DOCUMENTS

CN 2307485 2/1999

(Continued)

OTHER PUBLICATIONS

English language abstract of JP 7-167647.

(Continued)

*Primary Examiner*—Frantz F. Jues
*Assistant Examiner*—Azim Rahim
(74) *Attorney, Agent, or Firm*—McKenna Long & Aldridge LLP

(57) ABSTRACT

Provided is a radiating apparatus of a built-in refrigerator that can improve heat radiation in a machine room of the refrigerator installed in a built-in cabinet. The radiating apparatus includes: a refrigerator body installed in a built-in cabinet; a machine room disposed at a rear lower side of the refrigerator body; a compressor installed at one side of the machine room; a condenser and a blower fan installed at the other side of the machine room; and an airflow guide member installed between the blower fan and the condenser, for guiding a suction of an external air toward the other side of the machine room and guiding a discharge of an air that has exchanged heat in the other side of the machine room.

9 Claims, 17 Drawing Sheets

U.S. PATENT DOCUMENTS

2004/0221602 A1 * 11/2004 Kim et al. ..... 62/259.1

FOREIGN PATENT DOCUMENTS

JP 06018143 A * 1/1994
JP 7-167647 7/1995
JP 2002310496 A * 10/2002
KR 20000003308 2/2000
KR 10-20050034164 4/2005

OTHER PUBLICATIONS

English Language abstract of KR 10-2005-0034164.

* cited by examiner

RADIATING APPARATUS OF BUILT-IN REFRIGERATOR

BACKGROUND OF THE INVENTION

1. Field of the Invention

The present invention relates to a refrigerator, and more particularly, to a radiating apparatus of a built-in refrigerator that can improve heat radiation in a machine room of the refrigerator installed in a built-in cabinet.

2. Description of the Related Art

A refrigerator is an apparatus to maintain an inner space at a low temperature by repeating a cooling cycle consisting of compression, condensation, expansion and evaporation of a refrigerant, thereby freshly keeping foods cold or frozen for a long time.

Since the refrigerator inevitably has a certain amount of volume, it is protruded out of a wall when installed on a wall of a kitchen or a living room. This is not good for a space saving as well as a beautiful appearance.

To solve the above drawback, there is proposed a built-in refrigerator that is installed in a cabinet as a furniture, looking to be an integral part of the kitchen or the living room.

FIG. 1 is a perspective view illustrating that a refrigerator body 2 is installed in a built-in cabinet 2 like a built-in furniture.

Referring to FIG. 1, the refrigerator body 2 installed in the built-in cabinet 1 is partitioned into a foods storage room and a machine room having a refrigerant circulation unit for maintaining an inside of the foods storage room at a low temperature. Owing to a characteristic of the built-in refrigerator, the refrigerator body 2 has an air flow passage in which air is introduced into the machine room through a lower side of the refrigerator and is discharged along a rear wall of the refrigerator. Thus, a technique for effectively irradiating heat generated in the machine room by smoothly performing heat exchange in the machine room is focused as an important issue.

FIG. 2 is a sectional view taken along the line A-A' of FIG. 1.

Referring to FIG. 2, the built-in refrigerator includes the refrigerator body 2 installed in the built-in cabinet 1, a door panel 3 for opening/closing a cold storage room and a freezer, a base plate 4 for supporting the refrigerator body 2, a wall cover base 5 vertically installed at a lower side of a front side of the refrigerator body 2 and having a vent hole 9, a machine room 6 installed at a rear side of the refrigerator body 2, a suction passage 12 communicating with an exterior through a lower side of the base plate 4 and the vent hole 9 of the wall cover base 5, and an exhaust passage 13 disposed at a rear side of the refrigerator body 2.

In the built-in refrigerator constructed as above, the refrigerator body 2 is inserted into a space provided as a built-in furniture in the built-in cabinet 1 spaced apart by a predetermined interval from a wall surface. The refrigerator body 2 has the door panel 3 at a front side thereof, a drawer cabinet at an upper portion thereof, and the base plate 4 at a lower portion thereof.

The base plate 4 is installed at the lower side of the refrigerator body 2 spaced apart by a predetermined interval from a bottom surface of the refrigerator body 2 to support the refrigerator body 2. The wall cover base 5 is installed at the lower side of the front side of the refrigerator body 2 so as to maker better the appearance of the built-in cabinet 1 and block an introduction of garbage from an exterior.

The machine room 6 is disposed at the rear and lower side of the refrigerator body 2. The machine room 6 includes a compressor 10, a condenser and a blower fan therein, and is protected by a back cover 7. Heat radiation in the machine room 6 is performed by air flowing through the back cover 7.

Also, heat generated in the machine room 6 is effectively irradiated through the heat radiation passages provided at the lower side and the rear side of the built-in cabinet 1. In other words, outer air is suctioned into the machine room 6 through the suction passage 12 formed at the lower side of the refrigerator body 2, and inner air of the machine room 6 is discharged through the exhaust passage 13 formed at the rear side of the refrigerator body 2.

For this purpose, the outer air is introduced through the vent hole 9 of the wall cover base 5 installed at the front and lower side of the built-in cabinet, and the introduced air flows along the suction passage 12 installed between the base plate 4 installed at the lower side of the built-in cabinet 1, and the bottom surface, and along the exhaust passage 13 between the refrigerator body 2 and the wall surface 8. The air flowing along the passages 12 and 13 irradiates heat from the machine room 6 through the back cover 7.

In the built-in refrigerator, a refrigerant sequentially passing through the compressor, the condenser (see 17 of FIG. 3), and a capillary tube is introduced into an evaporator (not shown), and is completely vaporized while passing through the evaporator, thereby depriving a surrounding of heat and cooling the surrounding. Thereafter, the air cooled by the evaporator is supplied to the cold storage room and the freezer, cooling the inside of the refrigerator, and the temperature-elevated cool air is fed back and is introduced into the evaporator.

At this time, when the compressor 10, the condenser and the blower fan of the machine room 6 operate, the air suctioned through the suction passage 12 formed at the lower side of the refrigerator body 2 is inducted toward the inside of the machine room 6, passes through the condenser and the blower fan, and is finally exhausted through the exhaust passage 13 formed at the rear side of the refrigerator body 2.

FIG. 3 is a front view of the machine room of a related art built-in refrigerator.

Referring to FIG. 3, the machine room 6 is provided with the compressor 10 disposed at one side, the blower fan 16 disposed at the other side, and the condenser 17 disposed at a center of the machine room 6. As the blower fan 16 operates, outer air is suctioned through suction holes 14 of the back cover 7, and the air blown by the blower fan 16 sequentially exchanges heat with the condenser 17 and the compressor 10 and is discharged through exhaust holes 15 of the back cover 7.

At this time, the air, which is heat-exchanged in the machine room 6, is exhausted to an outside through the exhaust passage 13, and new air is introduced through the suction passage 12, thereby forming an air circulation.

However, since the related air built-in refrigerator has the structure that heat radiation of the blower fan 16 and the condenser 17 of the machine room 6 is performed by inhaling air through the back cover 7 to exchange heat and again discharging the heat-exchanged air through the back cover 7, there may occur a circulation phenomenon that the air discharged from the machine room 6 is again suctioned into the suction holes 14 or is again introduced via the compressor 10, resulting in the lowering in the heat transfer efficiency.

SUMMARY OF THE INVENTION

Accordingly, the present invention is directed to a radiating apparatus of a built-in refrigerator that substantially obviates one or more problems due to limitations and disadvantages of the related art.

A first object of the present invention is to provide a radiating apparatus of a built-in refrigerator that can prevent a passage of an air suctioned into a machine room of the built-in refrigerator from being mixed with a passage of an air discharged from the machine room.

A second object of the present invention is to provide a radiating apparatus of a built-in refrigerator provided with an airflow guide member partitioning an inside/outside of a machine room into an upper side and a lower side such that an air discharged from the machine room is not again introduced into the machine room.

A third object of the present invention is to provide a radiating apparatus of a built-in refrigerator provided with an airflow guide member partitioning an inside/outside of a condensing part of a machine room into an upper side and a lower side, thereby guiding suction of an outer air and a discharge of a heat-exchanged air.

A fourth object of the present invention is to provide a radiating apparatus of a built-in refrigerator provided with an airflow guide member partitioning an inside/outside of a machine room into an upper side and a lower side, thereby preventing an air suctioned into a machine room of the built-in refrigerator from being mixed with an air discharged from the machine room.

A fifth object of the present invention is to provide a radiating apparatus of a built-in refrigerator having suction duct installed at a lower side of a machine room.

A sixth object of the present invention is to provide a radiating apparatus of a built-in refrigerator having a discharge passage guide for guiding a discharge air toward a read side of the built-in refrigerator up to a predetermined height.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a radiating apparatus including: a refrigerator body installed in a built-in cabinet; a machine room disposed at a rear lower side of the refrigerator body; a compressor installed at one side of the machine room; a condenser and a blower fan installed at the other side of the machine room; and an airflow guide member installed between the blower fan and the condenser, for guiding suction of an external air toward the other side of the machine room and guiding a discharge of heat-exchanged air in the other side of the machine room.

In another aspect of the present invention, there is provided a radiating apparatus of a built-in refrigerator including: a refrigerator body installed in a built-in cabinet; a machine room disposed at a rear lower side of the refrigerator body; a compressor installed at one side of the machine room; a condenser and a blower fan installed on a radiating passage of the other side of the machine room; a back cover coupled to a rear side of the machine room so as to cover the machine room; and a discharge airflow guide part of which inside is opened such that an air discharged by the blower fan is induced to a predetermined height.

In another aspect of the present invention, there is provided a radiating apparatus of a built-in refrigerator comprising: a machine room including a compressor section in which a compressor is accommodated and a condenser section in which a condenser in which a refrigerant that passes through the compressor exchanges heat with air is accommodated; a blower fan for introducing the air into the machine room; a vertical barrier for partitioning the machine room into the compressor section and the condenser section; and an airflow guide horizontally formed between the condenser and the blower fan, the airflow guide having one edge curved upward.

In another aspect of the present invention, there is provided a radiating apparatus of a built-in refrigerator including: a refrigerator body installed in a built-in cabinet; a machine room disposed at a rear lower side of the refrigerator body; a compressor installed at one side of the machine room; a condenser and a blower fan installed at a front and a rear side of the other side of the machine room; and a suction duct installed at the other lower side of the machine room, for guiding suction of an external air.

According to an embodiment of the present invention, a guide member for guiding an external air suctioned from a lower side of a built-in cabinet and an air that exchanges heat in the machine room and is discharged, not to be mixed with each other, is provided so as to more effectively radiate heat generated in the machine room.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

FIRST EMBODIMENT

Figure 1:
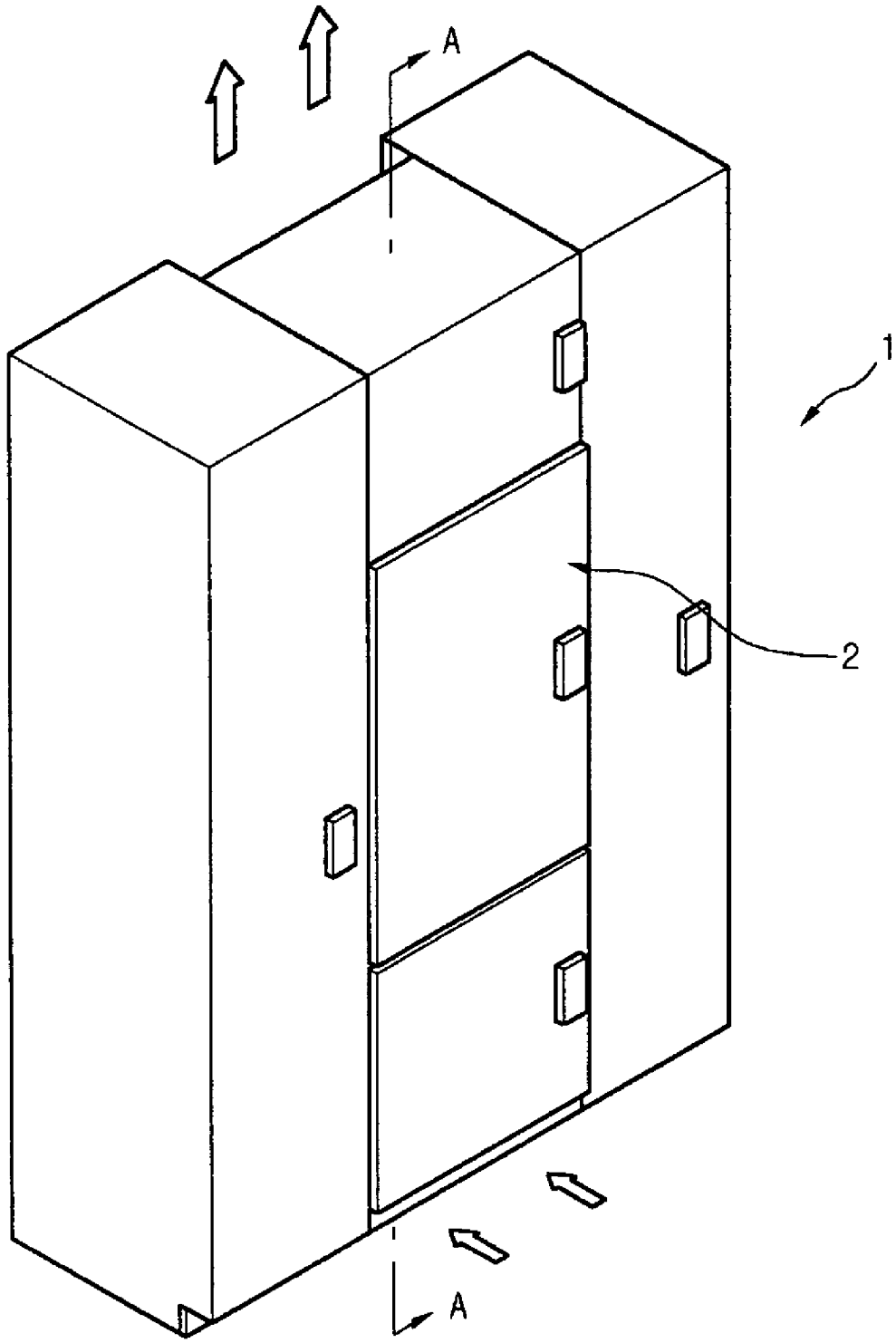
Fig.1 Related Art
FIG. 1 is a perspective view illustrating a general built-in refrigerator according to the related art.
Figure 2:
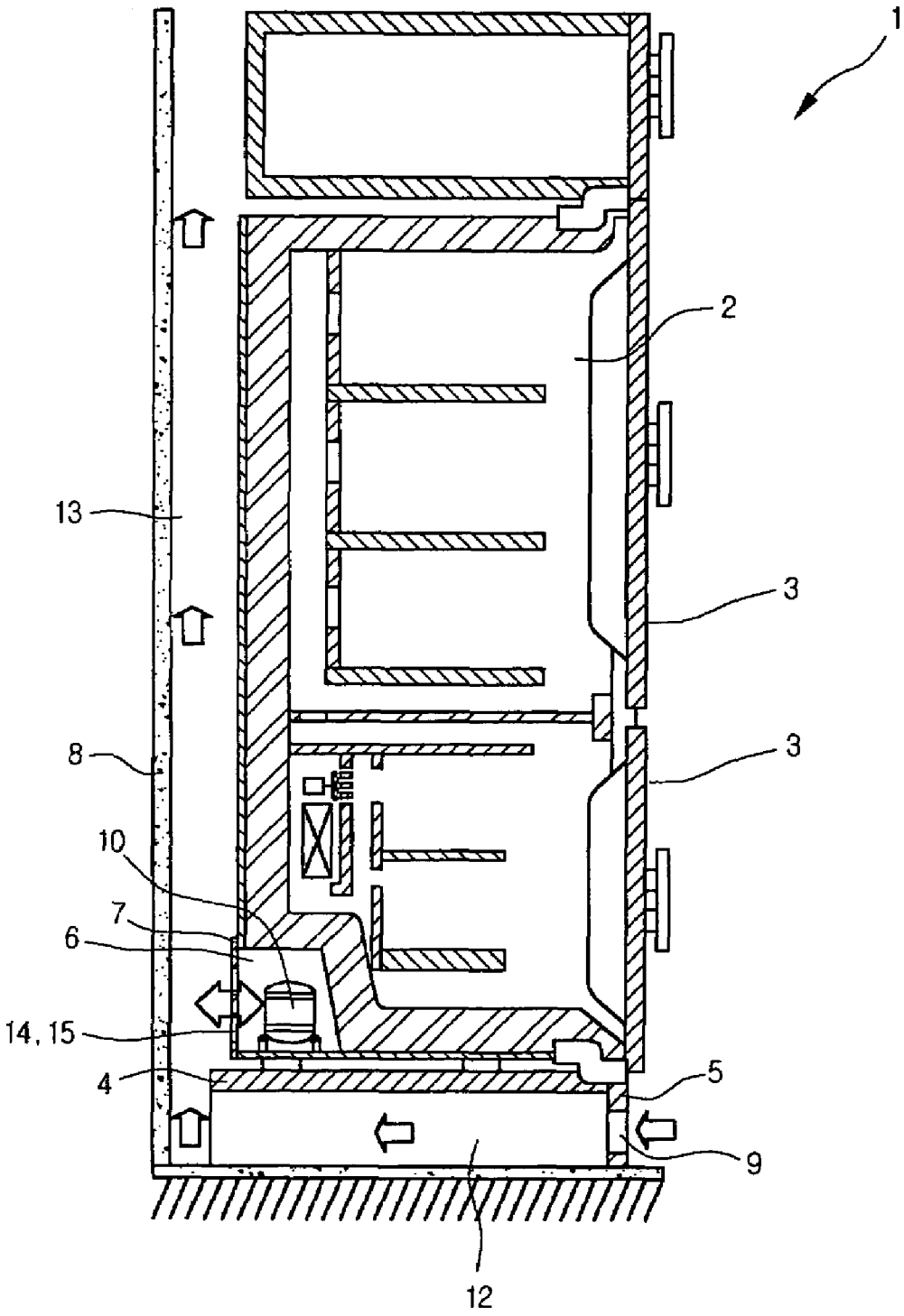
Fig.2 Related Art
FIG. 2 is a sectional view taken along the line A-A' of FIG. 1.
Figure 3:
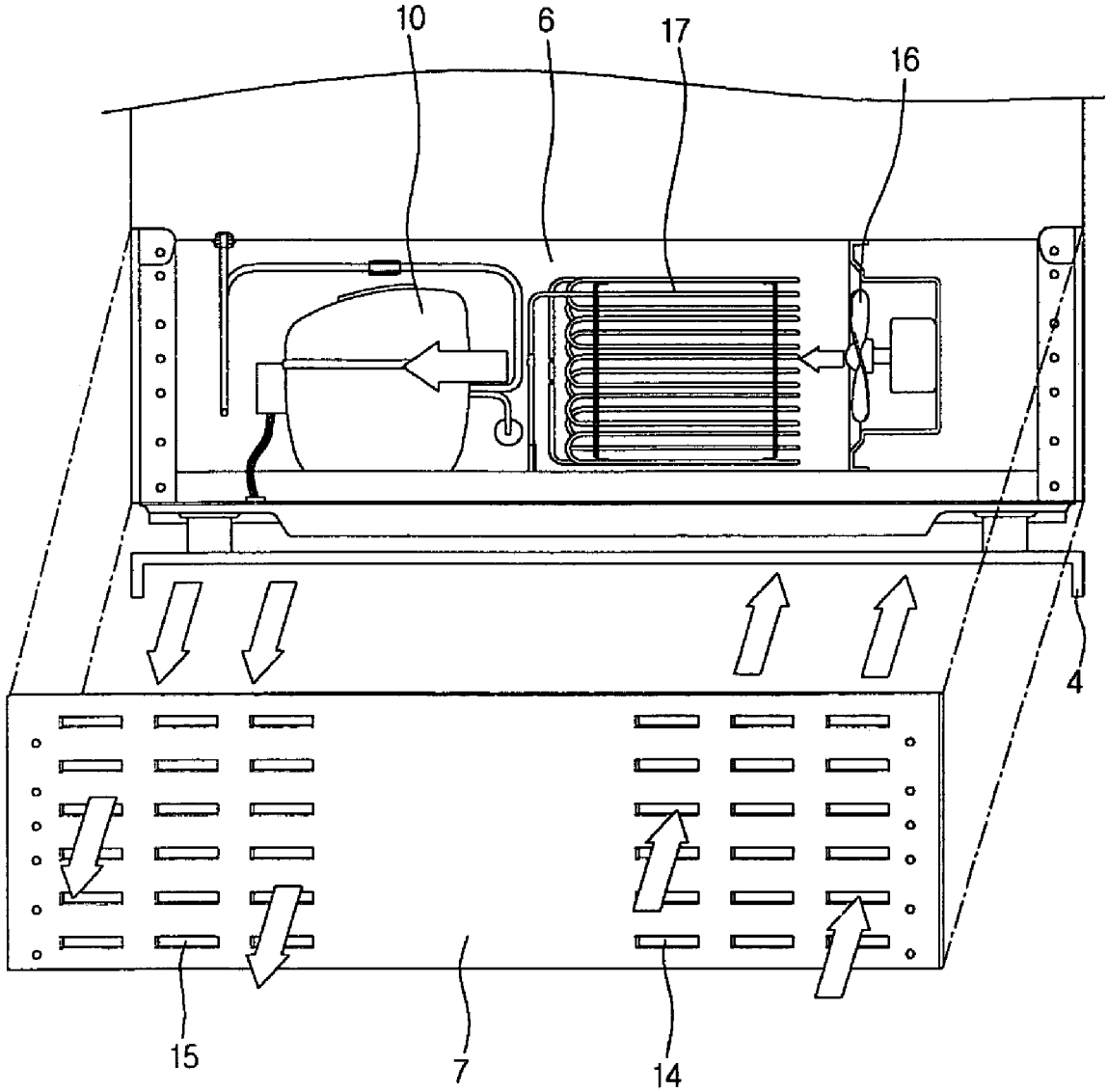
Fig.3 Related Art
FIG. 3 is a schematic view illustrating a structure of a machine room according to the related art.
Figure 4:
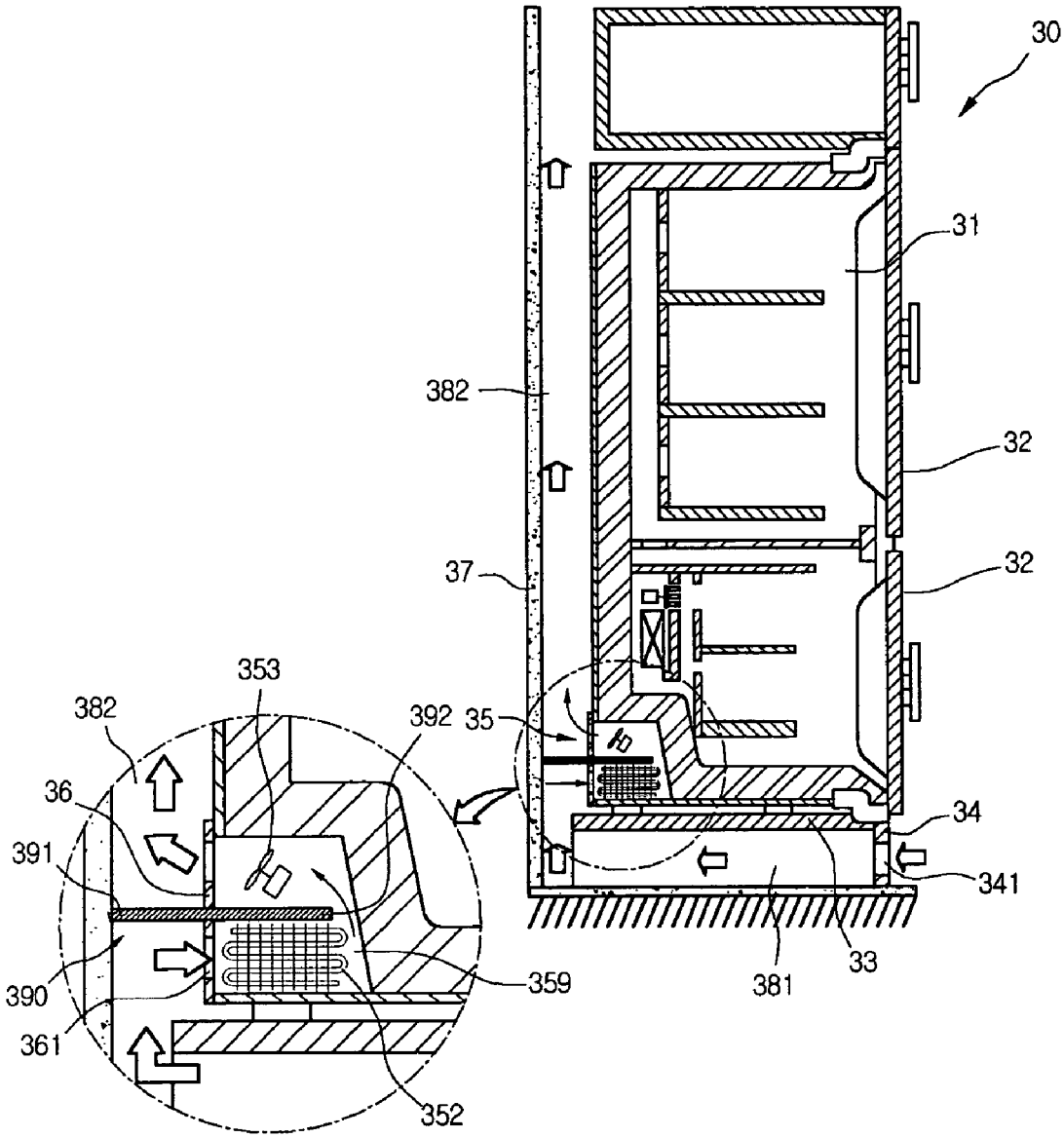
FIG. 4 is a side sectional view of a radiating apparatus of a built-in refrigerator according to a first embodiment of the present invention.
Figure 5:
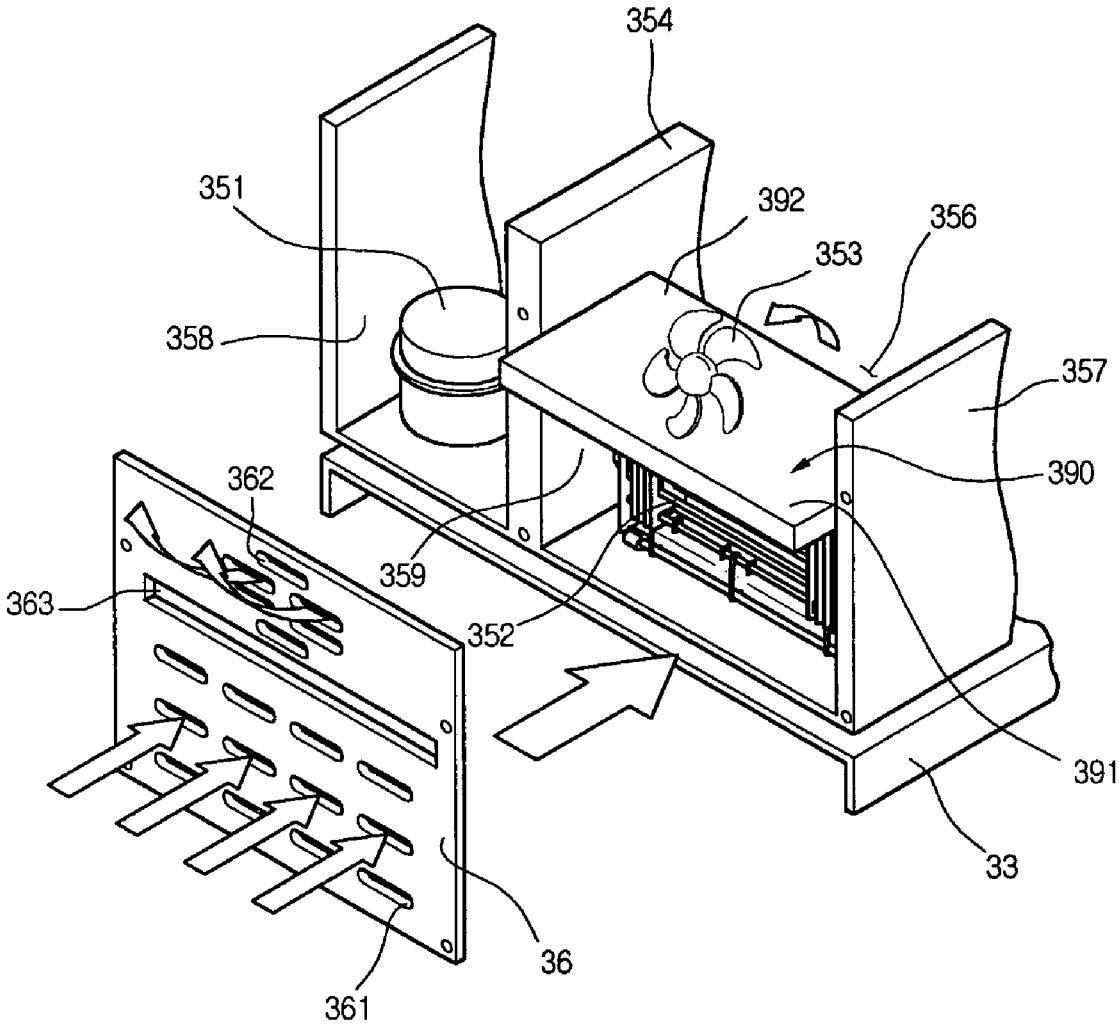
FIG. 5 is an exploded perspective view of a radiating apparatus of a built-in refrigerator according to the first embodiment of the present invention.
Figure 6:
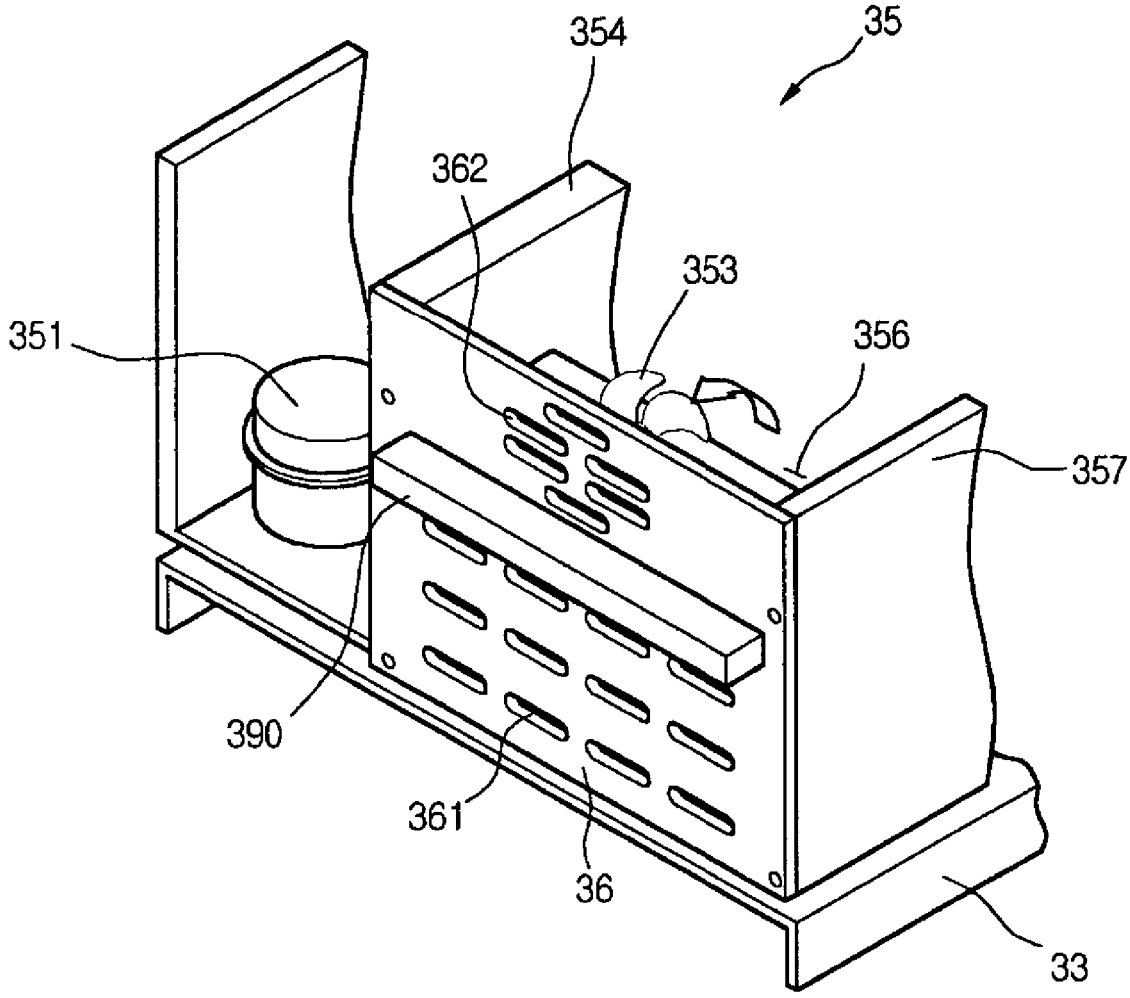
FIG. 6 is a partial perspective view of a radiating apparatus of a built-in refrigerator according to the first embodiment of the present invention.
Figure 7:
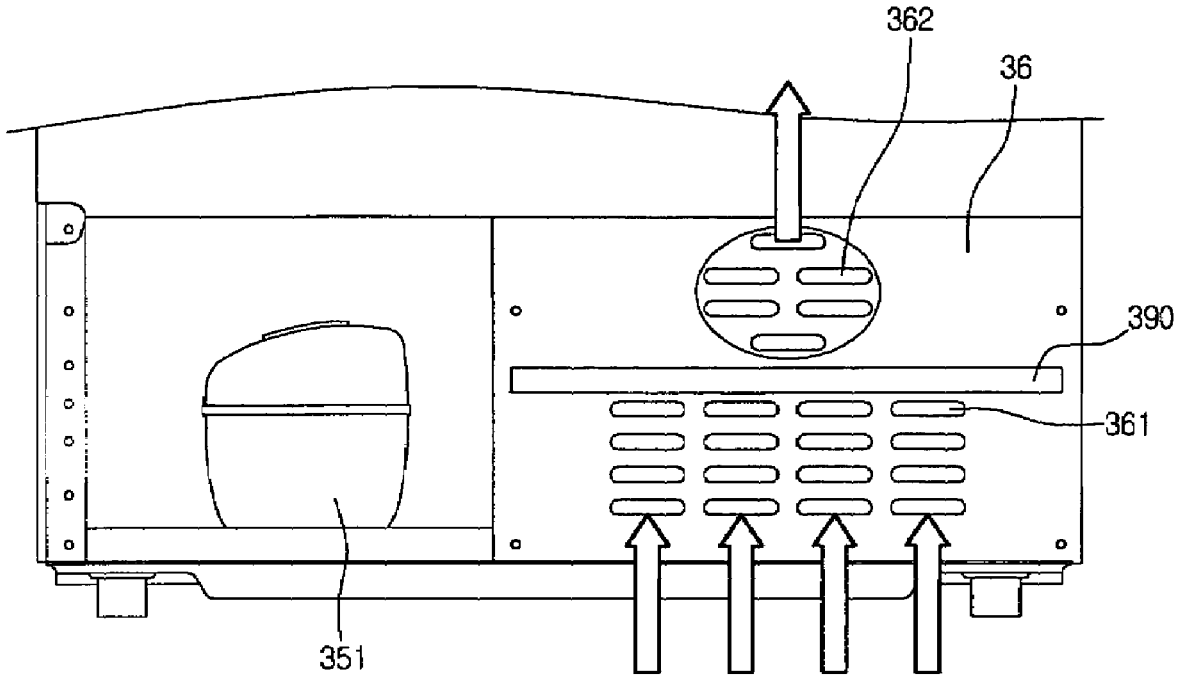
FIG. 7 is a rear view of a machine room of a built-in refrigerator according to an embodiment of the present invention.

FIGS. 4 through 7 are views illustrating a first embodiment of the present invention. Specifically, FIG. 4 is a side sectional view of a radiating apparatus of a built-in refrigerator according to a first embodiment of the present invention, FIG. 5 is an exploded perspective view of a radiating apparatus of a built-in refrigerator according to the first embodiment of the present invention, FIG. 6 is a partial perspective view of a radiating apparatus of a built-in refrigerator according to the first embodiment of the present invention, and FIG. 7 is a rear view of a machine room of a built-in refrigerator according to an embodiment of the present invention.

Referring to FIGS. 4 through 7, the built-in refrigerator includes a refrigerator body 31 installed in a built-in cabinet 30, a door panel 32 installed at a front side of the refrigerator, a base plate 33 and a wall cover base 34 disposed at a lower side of the refrigerator body 31, a machine room 35 installed at a rear lower side of the refrigerator body 31 and having a vertical plate 354 partitioning an inside thereof into a compressing section 358 and a condensing section 359, an airflow guide part 390 for guiding suction and discharge of an external air by selectively shielding an upper side or a lower side of the condensing section 359; a back cover covering the condensing section 359 of the machine room 35, a suction passage 381 formed at a lower side of the refrigerator body 31, for inducing suction of the external air, and a radiation passage including a discharge passage 382 formed along an inner wall.

The machine room 35 is designed such that a compressor 351 is disposed at the compressing section 358, a blower fan 353 and a condenser 352 are positioned at an upper side and a lower side of the condensing section 359, and the airflow guide part 390 is installed to shield an inside and an outside of the condensing section 359 in an upper and a lower direction.

The airflow guide part 390 includes a first airflow guide 391 protruded toward a wall direction, for partitioning a space between a lower suction inlet 361 and an upper discharge outlet of the back cover 36, and a second airflow guide 392 provided therein with a suction hole 356, for partitioning a space between the condenser 352 disposed at the lower side of the machine room and the blower fan 353 disposed at the upper side of the machine room.

An operation of the built-in refrigerator constructed as above according to the first embodiment of the present invention will now be described.

As shown in FIG. 4, the built-in cabinet 30 is installed therein with the refrigerator body 31, and the door panel 32 is installed at the front side of the refrigerator body 31. The base plate 33 and the wall cover base 34 are installed at a lower side of the built-in cabinet 30.

The refrigerator body 31 is installed spaced away from the inner wall 27, and the machine room 35 for a cooling cycle is disposed at the rear lower side of the refrigerator body 31. The suction passage 381 and the discharge passage 382 are respectively formed at the lower side and the rear side of the machine room 35.

As shown in FIGS. 4 and 5, the machine room 35 is partitioned into the compressing section 358 and the condensing by the vertical plate 354 so that the compressing section 358 and the condensing section 359 are shielded by the vertical plate 354. The condensing section 359 is partitioned into an upper side and a lower side by the airflow guide part 390. The condenser 352 is disposed at the partitioned lower side of the condensing section 359 and the blower fan 352 is disposed at the partitioned upper side. The airflow guide part 390 partitions the inside and the outside of the condensing part 359 into an upper side and a lower side.

The airflow guide part 390 has the suction hole 356 communicating the condenser 352 with the blower fan 353 at the inside thereof, thereby forming an air passage between the condenser 352 and the blower fan 353.

The compressing section 358 has the compressor 351 installed therein and is opened without any back cover. The condensing section 359 has the back cover 36 coupled thereto. The suction holes 361 and the discharge holes 362 are formed at the upper side and the lower side of the back cover 36 by the airflow guide part 390. The suction holes 361 and the discharge holes 362 are formed in plurality such that the suction holes 361 communicate with the condenser 352 and the discharge holes 362 communicate with the blower fan 353. The discharge holes 362 are formed in plurality within a rotational radius of the blower fan 353.

At a center of the back cover 36, a guide passing slot 363 is formed in a lateral direction such that the airflow guide part 390 passes through. As another embodiment, the back cover 36 may be installed to cover both the condensing part and the compressing part, having a plurality of vent holes at left and right sides thereof.

The back cover 36 is fixedly coupled to the vertical plate 354 and a side plate 357 by a screw, thereby protecting the condensing section 359.

The airflow guide part 390 is a flat plate and is installed in a lateral direction at a central portion of the condensing section 358 between the vertical plate 354 and the side plate 357 of the machine room 357. The airflow guide part 390 is preferably designed such that both ends thereof are slidingly coupled into the vertical plate 354 and an inside of the machine room. Also, the airflow guide part 390 is coupled by a coupling means such as a screw, or is formed integrally with the machine room inside the machine room.

Alternatively, the first airflow guide 391 protruded to the inner wall in an outer direction of the machine room is formed integrally with the second airflow guide 392 extending by a width of the condenser 352 toward the inside direction of the refrigerator body.

As shown in FIGS. 6 and 7, by disposing the back cover 36 at the condensing part 392 of the machine room 35 and passing the airflow guide part 390 through the guide passing slot 363 of the back cover 36, the first airflow guide 391 is disposed between the back cover and the inner wall 37, and the second airflow guide 392 is disposed between the condenser 352 and the blower fan 353. In this state, the back cover 36 is fixed to the machine room 35 by a screw.

In the radiating operation of the machine room according to the first embodiment of the present invention, as the built-in refrigerator 31 operates, the compressor 351 and the condenser 352 of the machine room 35 generate heat and accordingly the blower fan 353 starts to operate.

As the blower fan 353 rotates, external air is suctioned into an inside of the machine room 35 and exchanges heat with the condenser 352. At this time, the external air is suctioned into a vent hole of the wall cover base 34 and is suctioned through the suction passage 381 of the base plate 33.

The external air is moved along the airflow guide part 390 and is then suctioned into the condensing section 359 of the machine room 35 through the suction holes 361 of the back cover 36. The air suctioned into the condensing section 359 exchanges heat with the condenser 352 to cool the condenser 352, and the heat-exchanged air is discharged through the discharge holes 362 of the back cover 36 by the operation of the blower fan 353. At this point, the air discharged by the condensing section 359 is not again introduced in a downward direction by the airflow guide part 390 but is exhausted to an outside through the discharge passage 382.

The airflow guide part 390 defines the suction passage 381 and the discharge passage 382 at the lower side and the rear side of the refrigerator body 31 to form the airflow passage communicating with the condensing section 359 of the machine room 35, thereby preventing the heat-exchanged air from being again introduced into the machine room 35 together with external cool air to increase radiating effect. Alternatively, the airflow guide part 390 may be made in the form of a radiating plate.

Figure 8:
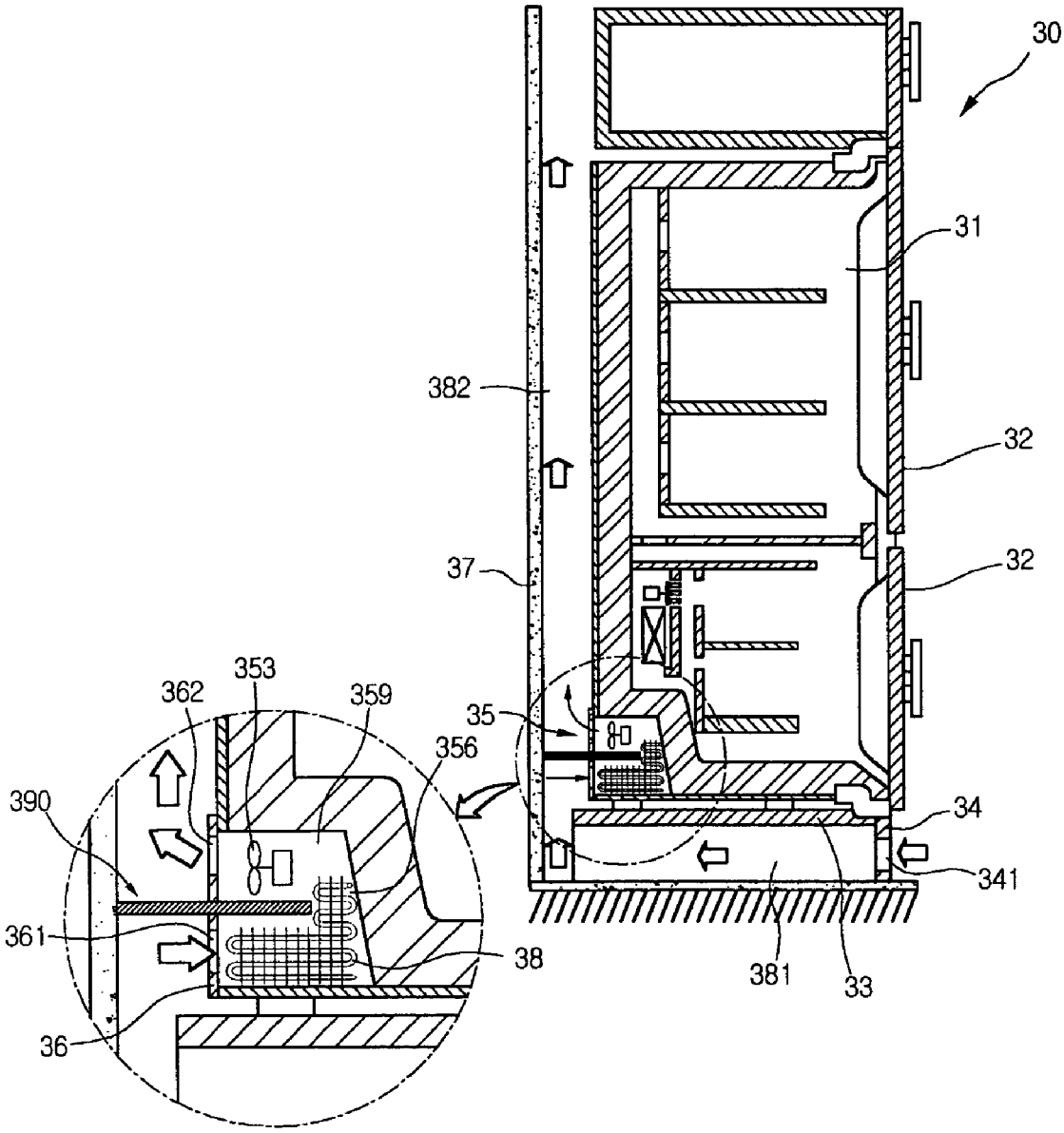
FIGS. 8 and 9 are side sectional views of a built-in refrigerator having an improved condenser structure according to the present invention.

FIG. 8 shows an example in which a condenser 38 having a different construction is employed in the first embodiment of the present invention. As shown in FIG. 8, the vertical plate is installed in the machine room 35 to isolate the compressing section and the condensing section from each other. The condensing section 359 is partitioned into the upper side and the lower side by the airflow guide part 390. The blower fan 353 is installed at the partitioned upper side and the condenser 38 is installed at the lower side of the condensing section 359.

The condenser 38 has a tube, which extends from a lower end of the condensing section 359 to an inner suction opening 356 in the form of 'ㄹ'. In other words, the tube of the condenser 38 extends from the lower end space of the condensing section 359 to a space where the inner suction opening is formed to increase the volume ratio, thereby increasing heat exchange area compared with the conventional refrigerator.

Figure 9:
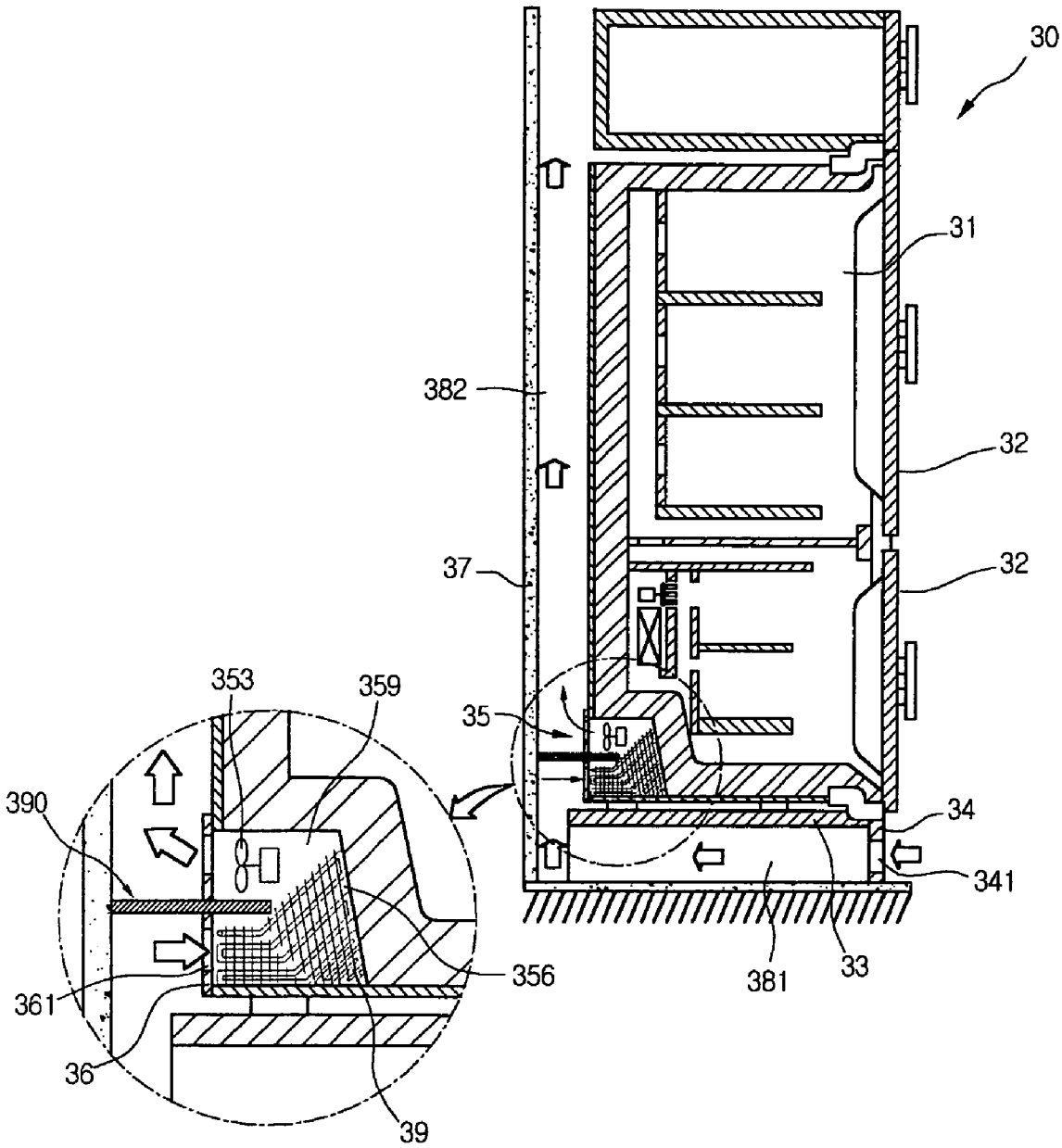

FIG. 9 shows another example in which a condenser having a different construction is employed in the first embodiment of the present invention. As shown in FIG. 9, the condenser 38 has a tube, which extends from a bottom surface of the condensing section 359 to an inner suction opening 356 in the form of 'ㄹ' having a curvature so as to increase the volume ratio.

A vertical plate is installed in the machine room 35 to isolate the compressing section and the condensing section from each other. The condensing section 359 is partitioned into the upper side and the lower side by the airflow guide part 390. The blower fan 353 is installed at the partitioned upper side and the condenser 38 is installed at the lower side of the condensing section 359.

SECOND EMBODIMENT

Figure 10:
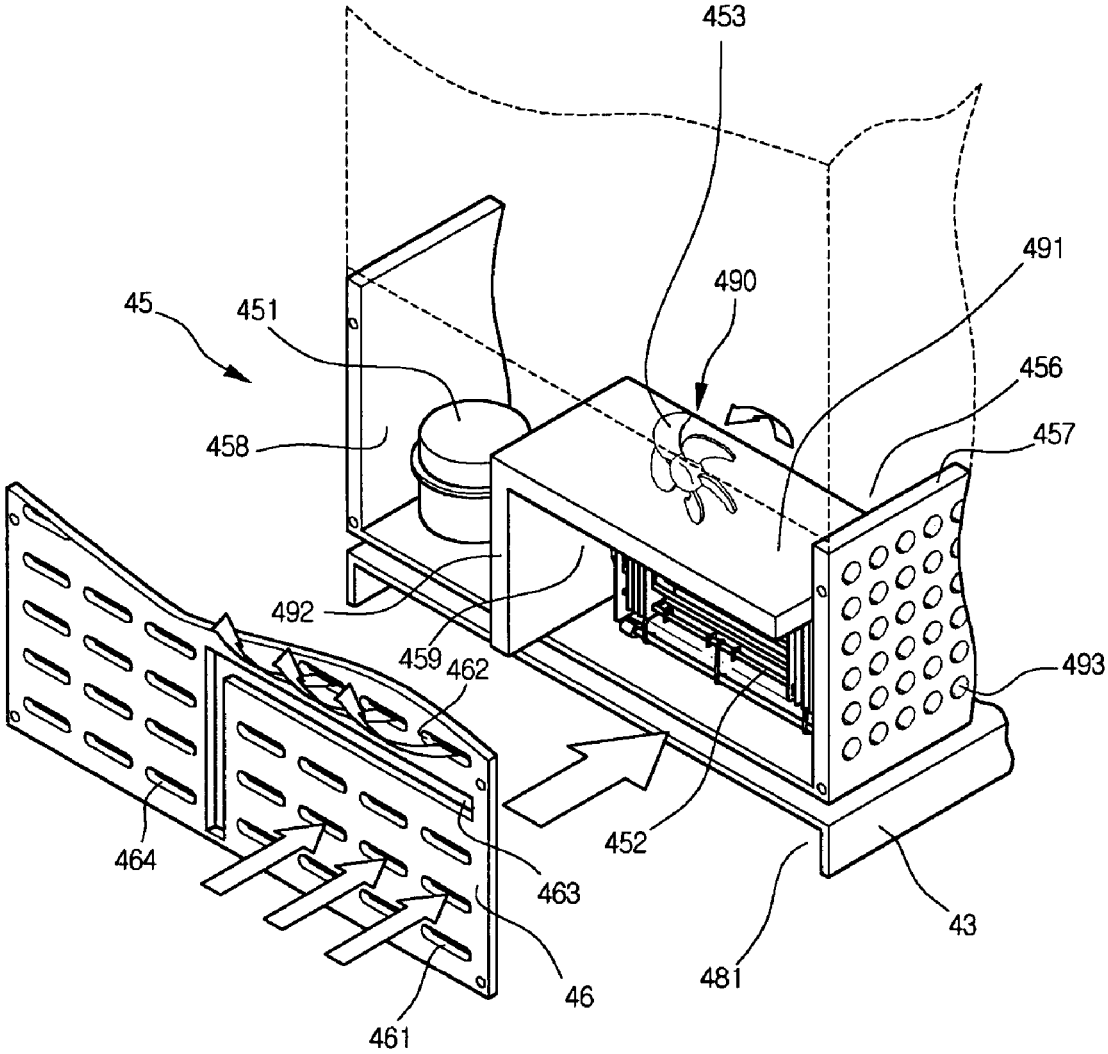
FIG. 10 is an exploded perspective view of a built-in refrigerator according to a second embodiment of the present invention.

FIG. 10 is an exploded perspective view of a built-in refrigerator according to a second embodiment of the present invention.

Referring to FIG. 10, a machine room 45 is partitioned into a compressing section 458 and a condensing section 459. An airflow guide part 490 bent in the form of 'ㄱ' is installed between the compressing section 458 and the condensing section 459.

The airflow guide part 490 has a horizontal plate 491 and a vertical plate 492 integrally bent from one end of the horizontal plate 491. The horizontal plate 491 partitions the condensing section 459 into an upper side and a lower side and the vertical plate 492 partitions the machine room 45 into a left side and a right side. A blower fan 453 is disposed at the partitioned upper side of the condensing section 459 and a condenser 452 is disposed at the partitioned lower side of the condensing section 459.

As a result, the machine room 45 is partitioned into the upper, lower, left and right sides by the 'ㄱ'-shaped airflow guide part 490. A suction opening 456 is formed in the machine room 45 so as to communicate the condenser 452 disposed at the lower side with the blower fan 453 disposed at the upper side.

The 'ㄱ'-shaped airflow guide part 490 also extends to an outside of the machine room 45 to partition an outer space of the machine room 45 into upper/lower side and left/right side, thereby guiding an introduction of external air and at the same time preventing heat-exchanged air from being again introduced. At this point, it is preferable that a buffer member is installed at an end of the airflow guide part 490 so as to buffer an impact between an exterior (i.e., wall surface) and the airflow guide part 490.

A back cover 46 has vent holes 464 communicating with the compressor 351 at one side thereof, and discharge holes 462 and suction holes 461 at upper and lower sides of the other side thereof. A guide passing slot 463 having a 'ㄱ' shape is formed along a central portion of the back cover 46 such that the airflow guide part 490 is coupled.

The airflow guide part 490 is inserted into the 'ㄱ'-shaped-guide passing slot 463 and is then fixed to a bottom or a side of the machine room 45 by a coupling means such as a screw. Alternatively, the airflow guide part 490 is fixed to the back cover 46 by a separate fixing member. Also, the airflow guide part 490 may be designed in a slidingly coupled or decoupled structure such that the refrigerator body can be freely moved.

The airflow guide part 490 formed in the shape of 'ㄱ' inside or outside the back cover 46 guides flow of air introduced into the machine room 45, and prevents air discharged from the machine room 45 from being again introduced into the lower side of the machine room 45.

The machine room 45 further includes a side surface 457 having a plurality of radiation holes 493 such that external air enters into or goes out of the machine room 45 through the radiation holes 493. These radiation holes 493 allow an amount of air inside the machine room to be sufficiently increased.

In a radiation operation in the machine room 45 according to the second embodiment of the present invention, as the built-in refrigerator operates, the compressor 451 and the condenser 452 of the machine room 45 essentially generate heat and accordingly the blower fan 453 starts to operate.

As the blower fan 453 operates, external air is suctioned through suction passage 481 formed at the base plate 43 and is introduced into the condenser 452 along the '⊓'-shaped airflow guide part 490 through the suction holes 461 of the back cover 46. The air introduced into the condenser 452 exchanges heat with the condenser 452, and the heat-exchanged air is discharged to the blower fan 453 through the suction opening 456.

At this point, the air discharged by the blower fan 453 is discharged through the discharge holes 462 of the back cover 46 and is then exhausted to an outside through the discharge passage.

The airflow guide part 490 is formed in the shape of '⊓' to shield the suction passage of external air from the discharge passage, thereby preventing the air discharged by the blower fan 453 from being mixed with the suctioned external air.

THIRD EMBODIMENT

Figure 11:
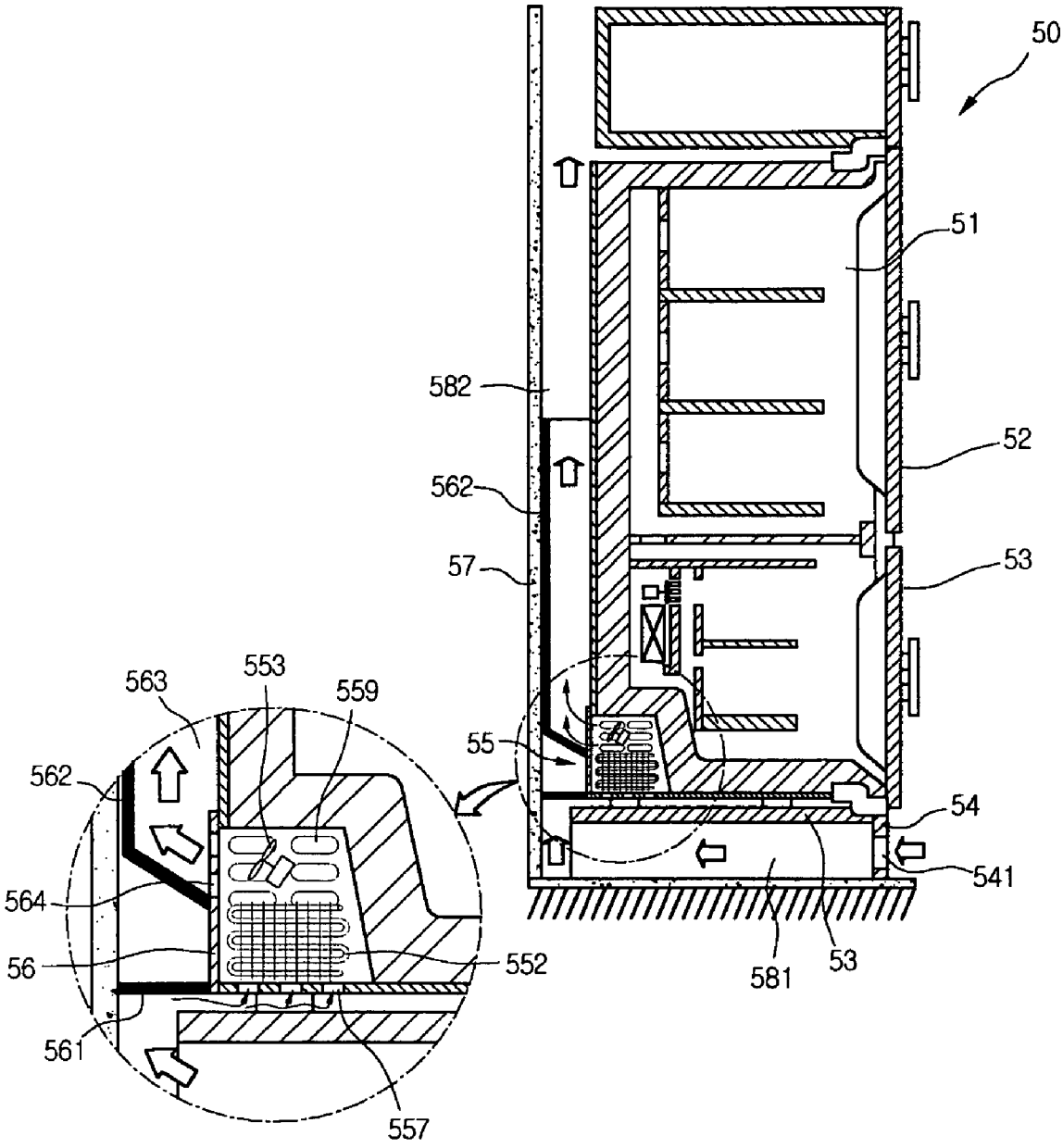
FIG. 11 is a side sectional view of a radiating apparatus of a built-in refrigerator according to a third embodiment of the present invention.
Figure 12:
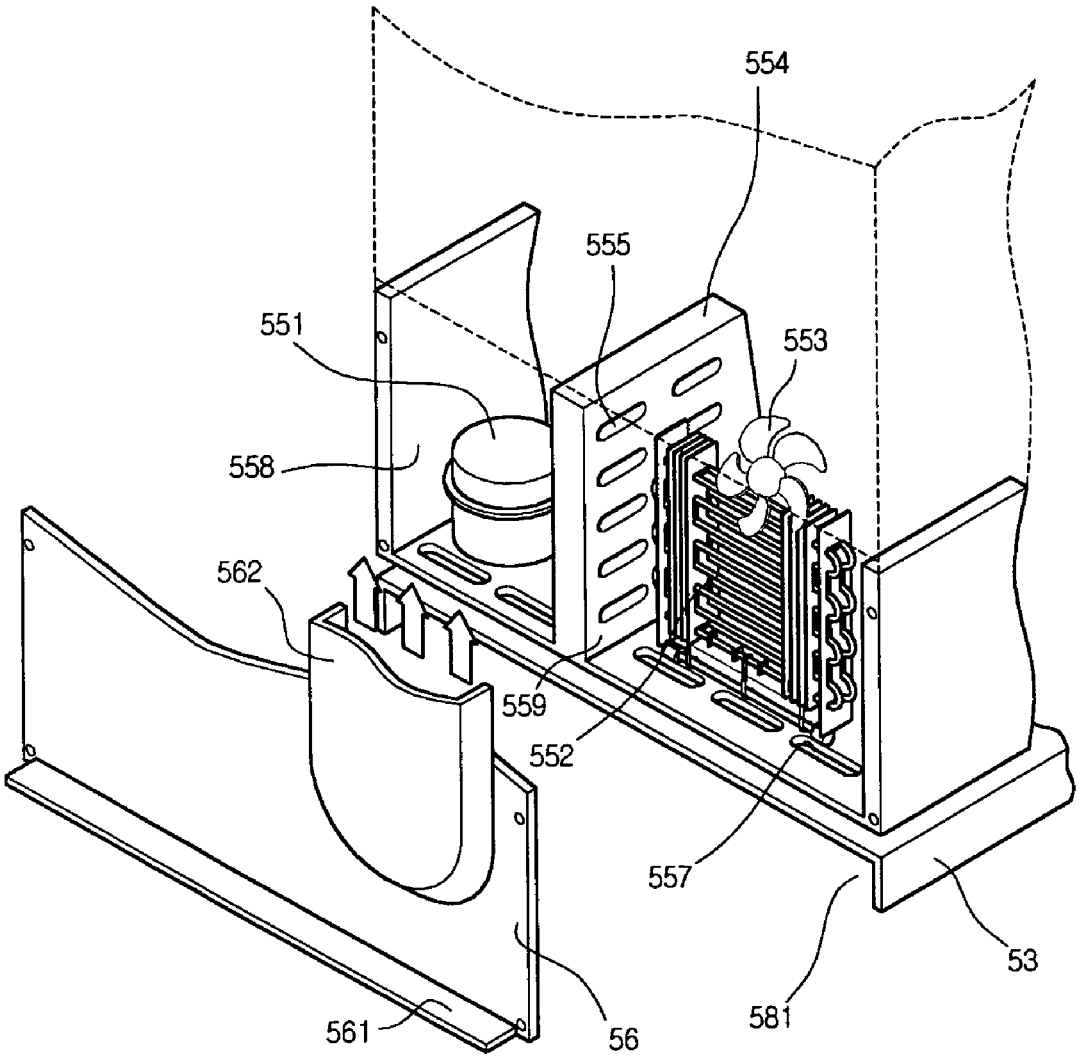
FIG. 12 is an exploded perspective view of a radiating apparatus of a built-in refrigerator according to the third embodiment of the present invention.
Figure 13:
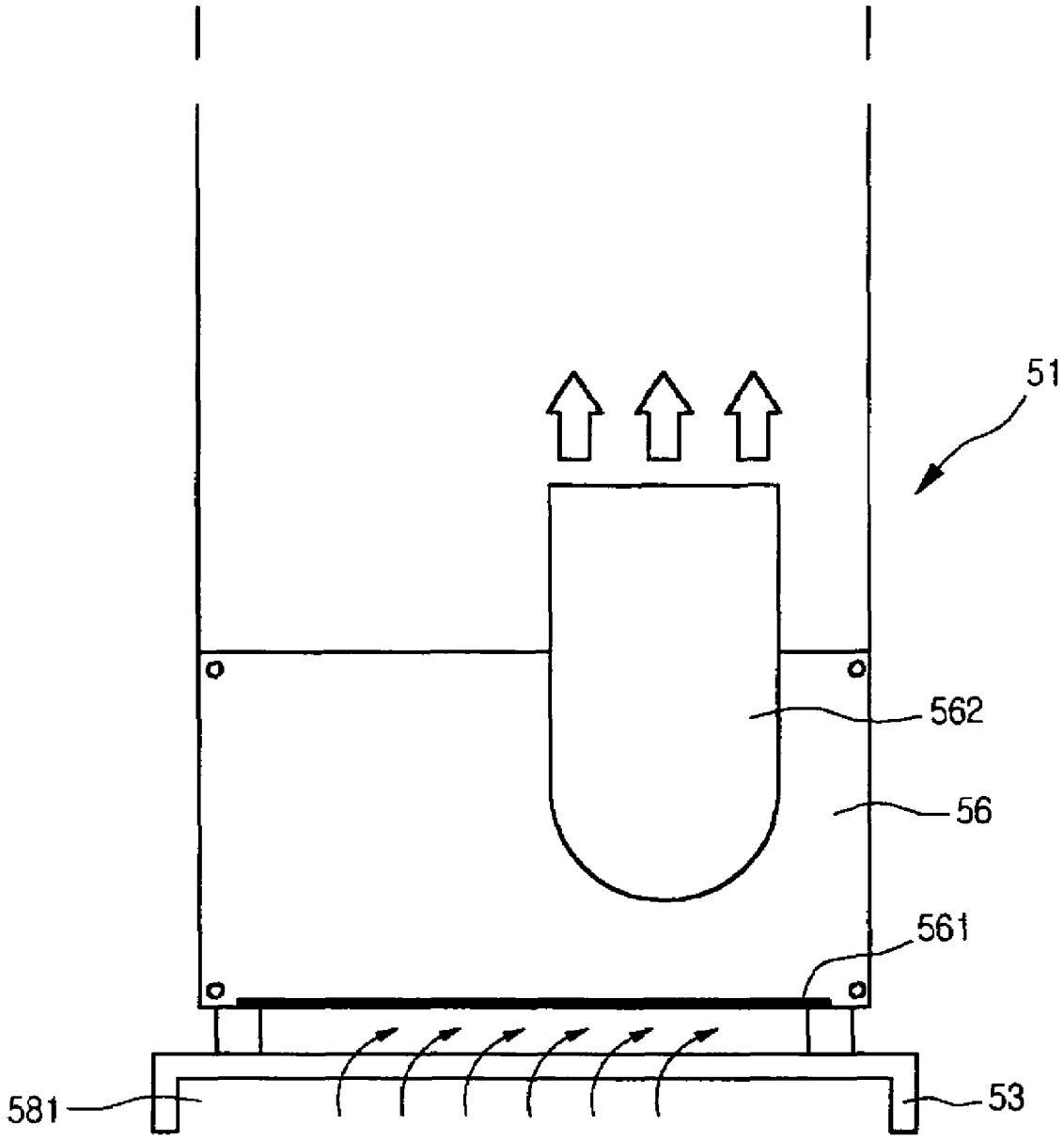
FIG. 13 is a rear view of a coupled radiating apparatus of a built-in refrigerator according to the third embodiment of the present invention.

FIGS. 11 through 13 show a construction of a built-in refrigerator according to a third embodiment of the present invention.

Referring to FIGS. 11 through 13, a machine room 55 is partitioned into a compressing section 558 and a condensing section 559 by a vertical plate 554 formed at a central portion thereof. A compressor 551 is disposed at the compressing section 558, and a blower fan 553 and a condenser 552 are positioned at an upper side and a lower side of the condensing section 559.

A plurality of suction holes 557 are formed at a bottom plate of the machine room 55 throughout an entire area of the bottom plate such that external air is introduced through the suction holes 557. A vent opening 555 is formed at the vertical plate 554 to communicate the compressing section 558 with the condensing section 559.

Also, the machine room 55 is provided with a back cover 56 covering an entire rear side of the machine room 55. The back cover 56 has an airflow shielding plate 561 protruded from a rear lower side of the machine room 55 to an inner wall 57, and a discharge outlet 564 communicating with the blower fan 453 disposed at a right upper side of the machine room 55.

An airflow guide 562 is installed at the discharge outlet 562 so as to guide a flow of discharged air. The airflow guide 562 is a duct structure extending by a predetermined height upward from the discharge outlet 564, and is installed at a rear surface of a refrigerator body 51 to communicate the discharge outlet 564 with a discharge passage 582. Herein, the blower fan 553 is installed with a slope upward such that the air discharged through the discharge outlet 564 is easily discharged through the airflow guide 562.

In other words, the airflow guide 562 is designed to communicate with the discharge outlet 564 of the back cover 56, an inner airflow passage 563 and the discharge passage 582 and induces the air discharged through the discharge outlet 564 in an upward direction by a predetermined height. As another embodiment, the discharge outlet of the back cover may be omitted by providing a structure that the air is directly discharged to the airflow guide 562.

In the radiating operation of the machine room according to the third embodiment of the present invention, as the built-in refrigerator 51 installed in the built-in cabinet 50 operates, the compressor 551 and the condenser 552 of the machine room 55 essentially generate heat and accordingly the blower fan 553 starts to operate. As the blower fan 553 operates, external air is suctioned through suction passage 581 and is then moved to a space where the compressor 551 and the condenser 552 are installed, through the suction holes 557 formed at the bottom plate of the machine room.

In other words, the external air is introduced through a vent hole 541 of a wall cover base 54 and the suction passage 581 installed at a lower side of the built-in cabinet 50. The introduced air is induced into the machine room 55 along a passage between the base plate 54 and the bottom surface. At this time, the external air is suctioned through the suction holes 557 formed at the bottom plate of the machine room 55 through a space between the base plate 53 of the built-in cabinet 50 and the refrigerator body 51.

At this time, the airflow shielding plate 561 shields the air suctioned through the suction passage 581 from being introduced into the discharge passage 582 and guides the air to be suctioned into the suction holes 557 as shown in FIGS. 12 and 13.

The air suctioned through the suction holes 557 formed at the bottom plate of the machine room 55 cools the condenser 552 and is then discharged by the blower fan 553. At this time, the discharged air is discharged to a predetermined height along the airflow guide 562 of the back cover 56 and is then exhausted to an outside through the discharge passage 582. Herein, the airflow guide 562 has a closed circumference and an opened internal passage 563 such that the air is induced upward through the opened internal passage 563.

Also, the air suctioned through the bottom plate of the compressing section 558 is introduced into the condensing section 559 through the vent holes 555 formed at the vertical plate 554 of the machine room 55 and is again discharged to the airflow guide 562 by the blower fan 553, so that the compressor 551 is also radiated.

Figure 14:
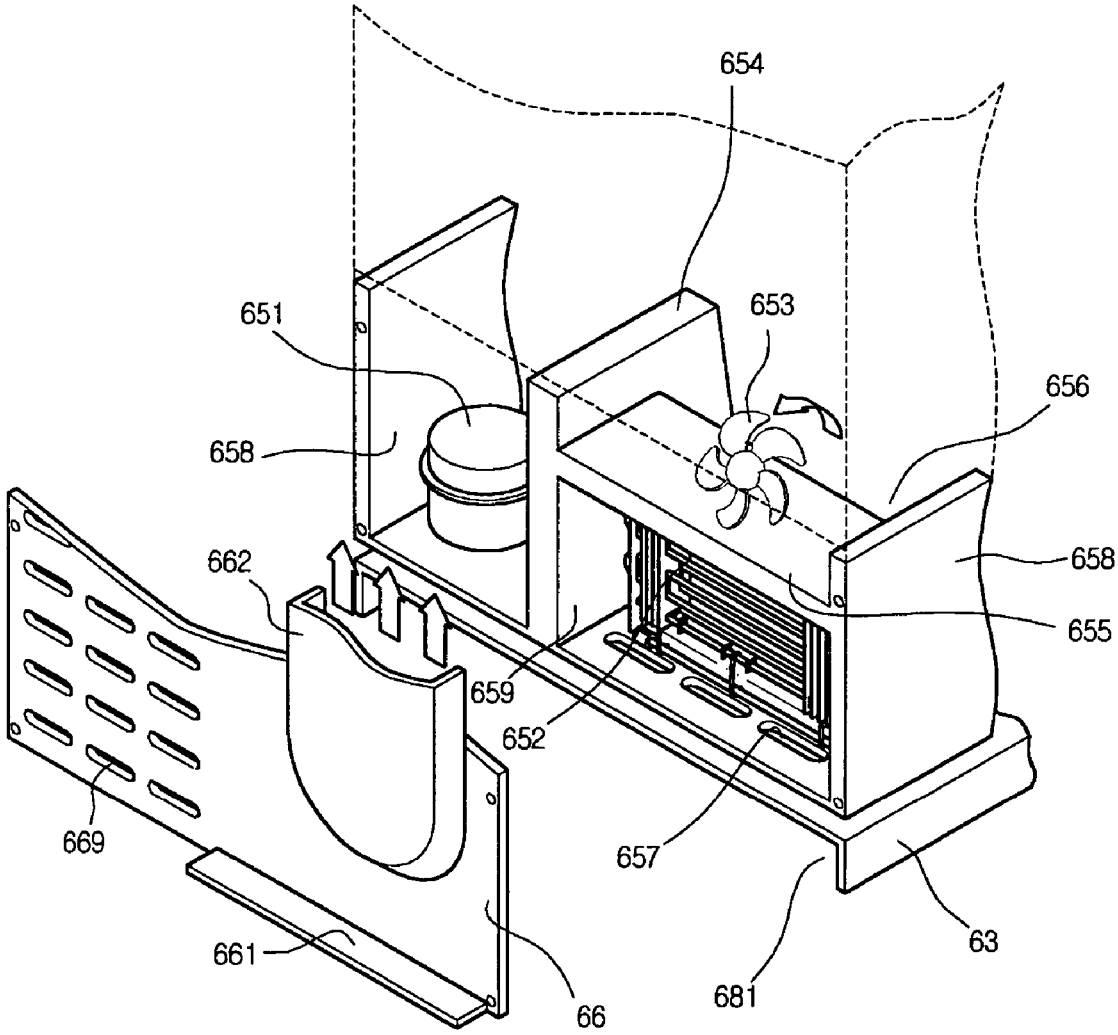
FIG. 14 is a perspective view illustrating an air passage structure according to the third embodiment of the present invention.

FIG. 14 is a perspective view illustrating an air passage structure according to the third embodiment of the present invention.

Referring to FIG. 14, a machine room 65 is partitioned into a compressing section 658 and a condensing section 659 by a vertical plate 654. The compressing section 658 is isolated from the condensing section 659. The condensing section 659 is partitioned into an upper side and a lower side by a horizontal plate 655. A blower fan 653 and a condenser 652 are installed at the upper side and the lower side of the condensing section 659.

A plurality of suction holes 657 are formed at a bottom plate of the machine room 65 such that external air is introduced through the suction holes 657.

The machine room 65 is also provided with a back cover 66. The back cover 66 has a plurality of vent holes 669 communicating with the compressor 651 at one side thereof, and an airflow shielding plate 661 outwardly protruded from a bottom end of the other side of the back cover 66. An airflow guide part 662 of which one end communicates with the blower fan 653 and the other end extends to a rear upper side of the refrigerator body is installed at an upper side of the airflow shielding plate 661.

In the machine room 65 constructed as above, as the blower fan 653 operates, external air is suctioned through the suction holes 657 formed at the bottom plate of the condensing section 659 to cool the condenser 652, and is discharged through suction opening 656 formed at a rear side of the condensing section 659 by the blower fan 653. At this point, the discharged air is induced up to a predetermined height along the airflow guide part 662 and is then exhausted to an outside.

According to the third embodiment of the present invention, a radiation passage is provided in which the airflow passage formed at the rear side of the machine room is shielded by the airflow shielding plate, external air is suctioned through the bottom plate of the machine room, and suctioned air is exhausted to an outside through the airflow guide part installed in a duct type having a predetermined height, thereby preventing heat exchange amount from being reduced due to the discharged air.

FOURTH EMBODIMENT

Figure 15:
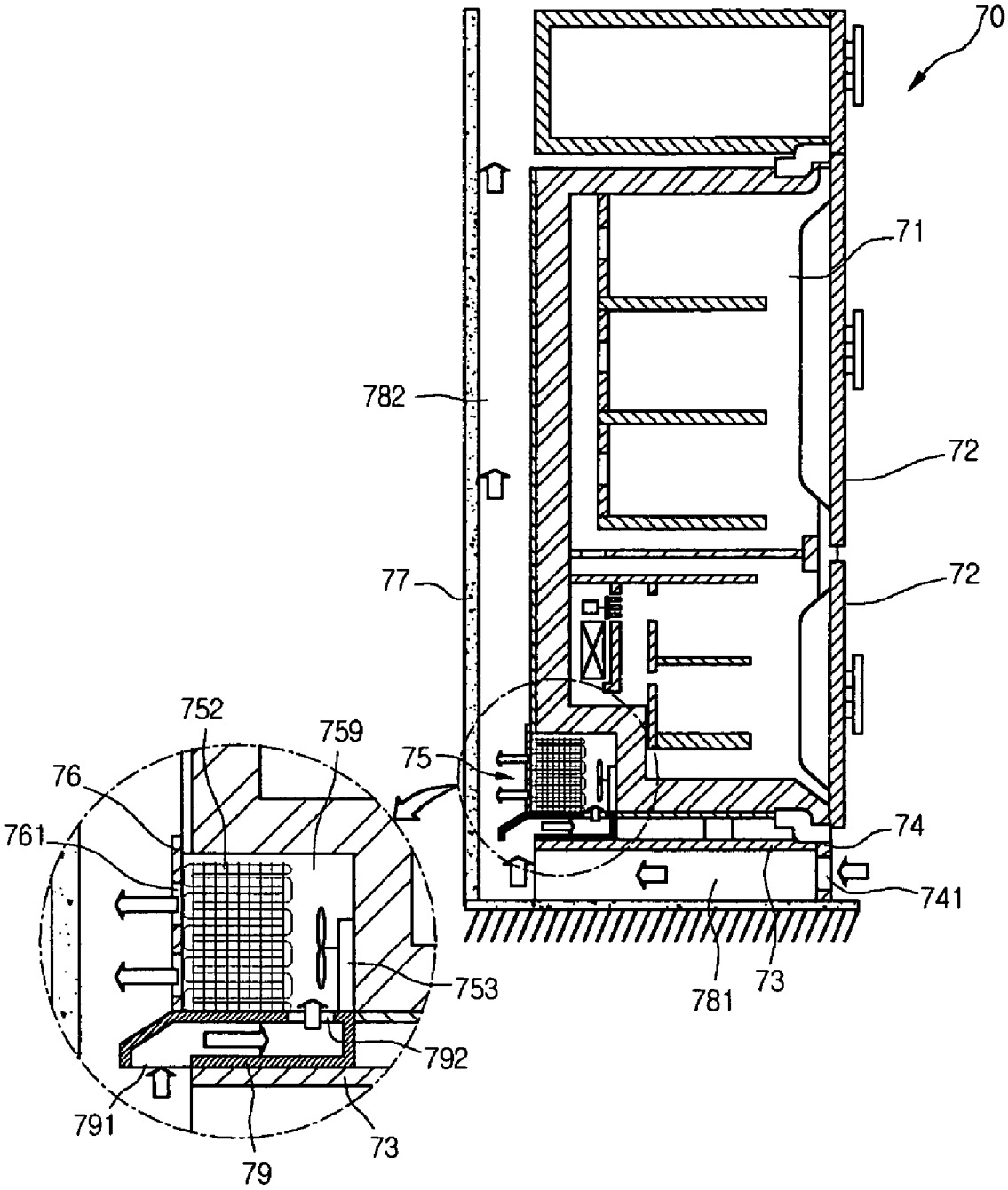
FIG. 15 is a side sectional view of a radiating apparatus of a built-in refrigerator according to a fourth embodiment of the present invention.
Figure 16:
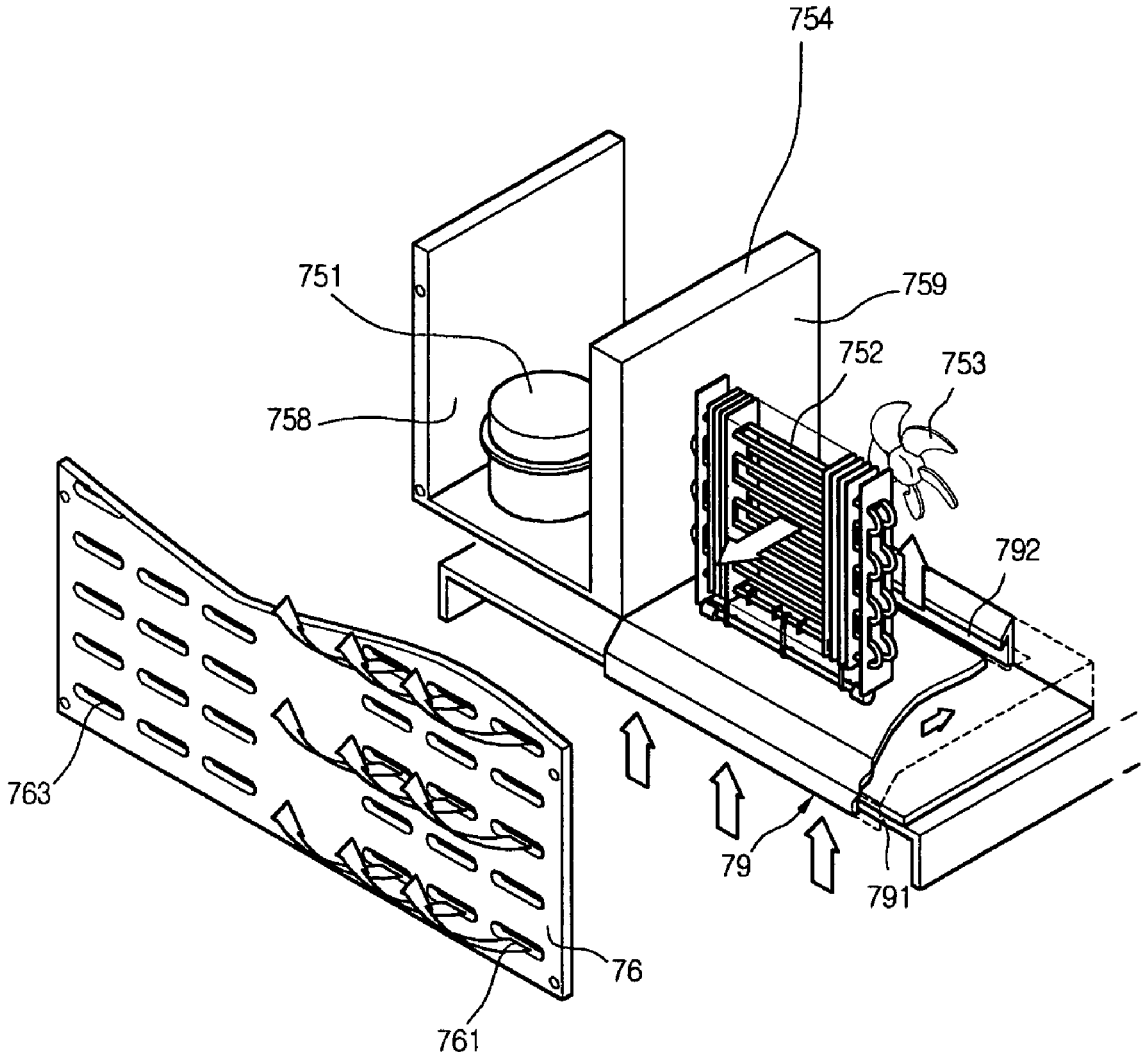
FIG. 16 is a partial exploded sectional view of a radiating apparatus of a built-in refrigerator according to the fourth embodiment of the present invention.
Figure 17:
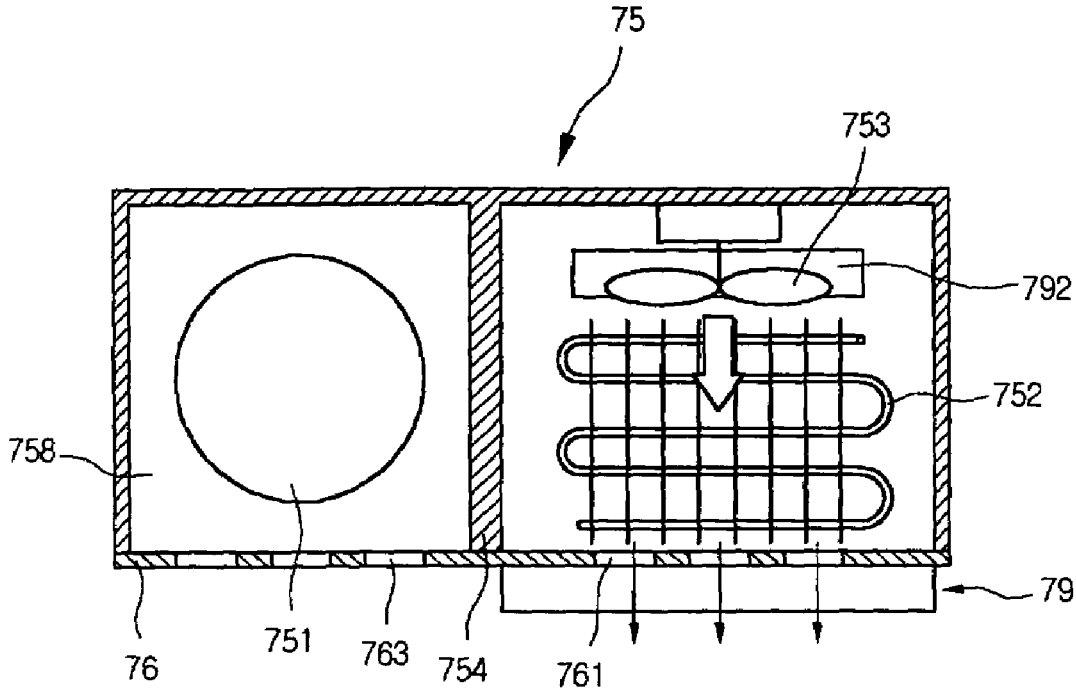
FIG. 17 is a plane view of a radiating apparatus of a built-in refrigerator according to the fourth embodiment of the present invention.

FIGS. 15 through 17 illustrate a fourth embodiment of the present invention.

Referring to FIGS. 15 through 17, a machine room 75 has a suction duct 79 integrally formed with the machine room 75 at a lower side of the machine room 75. The suction duct 79 guides an external air to be introduced into a lower side of the machine room 75.

The machine room 75 is partitioned into a compressing section 758 of a left side and a condensing section 759 of a right side by a vertical plate 754. A compressor 751 is disposed at the compressing section 758, and a condenser 752 and a blower fan 753 are respectively positioned at a front side and a rear side of the condensing section 759.

To guide a suction of external air, the suction duct 79 is installed between a bottom surface of the machine room 75 and an upper surface of a base plate 73. The suction duct 79 is formed in the shape of '⌐', and has a suction inlet 791 communicating with a suction passage 781 and protruded downwardly at one side thereof such that an air introduced through a vent hole 741 of a wall cover base 74 is easily introduced into the machine room 75, and a discharge outlet 792 formed at the other side of the duct 79 and communicating with the condensing section 759 of the machine room 75 to induce the air introduced into the duct 79 to the condensing section 759 of the machine room 75.

Accordingly, as the external air is suctioned through the discharge outlet 792 of the suction duct 79 and is discharged toward the condenser 792 disposed at the front side of the machine room 75 by the blower fan 793, the external air exchanges heat with the condenser 793 to cool the condenser 793 and the heat-exchanged air is exhausted through a discharge hole 761 of the back cover 76.

At this time, the air discharged through the discharge hole 761 of the back cover 76 is not again introduced through the suction inlet 791 of the suction duct 79 but is exhausted to an outside through a discharge passage 782. Since the back cover 76 has a plurality of vent holes 763 formed facing the compressor, heat is radiated by a natural circulation.

The embodiments of the present invention illustrate various radiating apparatuses employed in a machine room. These radiating apparatuses shield the air suctioned into the machine room and the air discharged to the machine room, and are provided with a vertical plate or a horizontal plate for the shielding, a duct or an airflow guide for easy introduction of a suctioned air and easy discharge of discharge air, thereby increasing heat exchange efficiency of the machine room.

As described above, a radiating apparatus of a machine room of a built-in refrigerator according to the present invention, the machine room is partitioned into an upper side and a lower side, and an air suction passage and an air discharge passage having an air exchanging heat with a condenser are shielded, thereby increasing heat exchange efficiency compared with the related art radiating apparatus.

Also, the present invention guides passages of airs flowing according to suction and heat exchange of external air, and discharge of the external air not to be mixed with one another, thereby increasing heat exchange efficiency in the machine room.

Further, a condenser and a blower fan are respectively disposed at a lower side and an upper side of a machine room, and an airflow guide member for partitioning the machine room into an inside and an outside is installed to shield discharged air from being again introduced, thereby maximizing heat radiation in an inside of the machine room as well as in the condenser.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A radiating apparatus of a built-in refrigerator, comprising:

a refrigerator body installed in a built-in cabinet;

a machine room disposed at a rear lower side of the refrigerator body;

a compressor installed at a first side of the machine room;

a condenser and a blower fan installed at a second side of the machine room; and an airflow guide member comprising a horizontal member which separates the second side of the machine room into an upper section and a lower section, wherein the condenser is located in the lower section of the second side of the machine room below the horizontal member and the blower fan is located in the upper section of the second side of the machine room above the horizontal guide member, and the airflow guide member extends outside of the machine room and defines an air intake passage through which air enters the lower section of the second side of the machine room, and an air discharge passage, through which air passes after exiting the upper section of the second side of the machine room.

2. The radiating apparatus of claim 1, wherein the airflow guide member guides external air suctioned into a lower side of the built-in cabinet to the condenser and guides air heat-exchanged by the condenser to the blower fan.

3. The radiating apparatus of claim 2, wherein the airflow guide member is disposed within the machine room to define an airflow passage between the condenser and the blower fan.

4. A radiating apparatus of a built-in refrigerator, comprising:

a refrigerator body installed in a built-in cabinet;

a machine room disposed at a rear lower side of the refrigerator body;

a compressor installed at a first side of the machine room;

a condenser and a blower fan installed at a second side of the machine room; and an airflow guide member, which is disposed and provides a partition between the condenser and the blower fan wherein the machine room comprises:

a compressing section in which the compressor is installed;

a condensing section in which the blower fan and the condenser are installed at an upper side and a lower side thereof;

a vertical plate that shields the compressing section from the condensing section; and a back cover that covers a rear side of the condensing section, and having a suction hole formed on a lower side thereof, a discharge hole formed on an upper side thereof, and a guide penetration hole through which the airflow guide member penetrates, wherein external air enters the machine room through the suction hole and heat-exchanged air exits the machine room through the discharge hole.

5. The radiating apparatus of claim 4, wherein the blower fan is installed in a direction of the discharge hole of the back cover with a predetermined slope at an upper side of the airflow guide member.

6. The radiating apparatus of claim 4, wherein the condenser comprises at least one portion substantially shaped as an 'S'.

7. The radiating apparatus of claim 1, wherein a plurality of radiating holes are formed in an outer wall of the machine room of the refrigerator body.

8. The radiating apparatus of claim 1, wherein the airflow guide member is substantially shaped as an 'L', partitions a space between the compressor and the condenser inside the machine room and a space between the condenser and the blower fan, respectively, and extends near a wall outside the machine room.

9. The radiating apparatus of claim 1, wherein the airflow guide member is substantially shaped as an 'L', and the radiating apparatus further comprises a back cover covering a rear side of the machine room and comprising a vent hole formed in a vicinity of the compressor, a suction hole formed in a vicinity of the condenser through which external air enters the machine room, a discharge hole formed in a vicinity of the blower fan through which heat-exchanged air is discharged, and a guide penetration hole, substantially shaped as an 'L', through which the airflow guide member penetrates.

* * * * *